US009364078B1

(12) United States Patent
Lai et al.

(10) Patent No.: US 9,364,078 B1
(45) **Date of Patent: *Jun. 14, 2016**

(54) FOLDING TABLE

(71) Applicants: Jennifer Ying Lai, Rancho Cucamonga, CA (US); Jiaxun Cao, Rancho Cucamonga, CA (US)

(72) Inventors: Jennifer Ying Lai, Rancho Cucamonga, CA (US); Jiaxun Cao, Rancho Cucamonga, CA (US)

( * ) Notice: Subject to any disclaimer, the term of this patent is extended or adjusted under 35 U.S.C. 154(b) by 0 days.
This patent is subject to a terminal disclaimer.

(21) Appl. No.: 14/940,448

(22) Filed: Nov. 13, 2015

Related U.S. Application Data

(63) Continuation-in-part of application No. 14/598,600, filed on Jan. 16, 2015, now Pat. No. 9,179,766, and a continuation-in-part of application No. 14/598,824, filed on Jan. 16, 2015, now Pat. No. 9,226,572.

(60) Provisional application No. 61/979,202, filed on Apr. 14, 2014, provisional application No. 61/951,206, filed on Mar. 11, 2014.

(51) Int. Cl.
*A47B 3/00* (2006.01)
*A47B 3/091* (2006.01)
*A47B 13/08* (2006.01)

(52) U.S. Cl.
CPC ..... *A47B 3/0915* (2013.01); *A47B 13/08* (2013.01)

(58) Field of Classification Search
CPC ..... A47B 3/00; A47B 3/02; A47B 3/08; A47B 3/0912; A47B 3/13; A47B 3/0915; A47B 2003/0821; A47B 2003/08; A47B 13/08
USPC ..... 108/115, 128, 48, 164
See application file for complete search history.

(56) References Cited

U.S. PATENT DOCUMENTS 1,256,197 A * 2/1918 Bettinardi ..... A47B 3/00 108/115
2,299,910 A * 10/1942 Linderme ..... A47B 3/0913 108/115
2,784,004 A * 3/1957 Hamrick, Jr. ..... B62B 1/12 108/48
3,322,077 A * 5/1967 Henry ..... A47B 3/00 108/115
5,592,887 A * 1/1997 Teng ..... A47B 21/00 108/134
5,775,655 A * 7/1998 Schmeets ..... A47B 5/00 108/115
5,819,670 A * 10/1998 O'Connor ..... A47C 9/06 108/134
6,192,808 B1 * 2/2001 Bue ..... A47B 3/0911 108/1
6,698,364 B2 * 3/2004 Welch ..... A47F 5/137 108/115
6,786,162 B1 * 9/2004 Volkmer ..... A47B 5/06 108/115
6,811,233 B1 * 11/2004 Packer ..... B25H 1/04 108/176
7,647,872 B2 * 1/2010 Pitchford ..... B23Q 1/74 108/48
8,365,676 B1 * 2/2013 McAuliff ..... A47B 5/06 108/48
9,179,766 B2 * 11/2015 Lai ..... A47B 3/0818
9,226,572 B2 * 1/2016 Lai ..... A47B 3/0818

(Continued)

*Primary Examiner* — Jose V Chen
(74) *Attorney, Agent, or Firm* — Clement Cheng

(57) ABSTRACT

A folding table has a plank member having a plank member forward end and a plank member rearward end. A substantially vertical member is pivotally connected to the plank member. The substantially vertical member has a substantially vertical member upper end and a substantially vertical member lower end. The plank member is pivotally connected to the substantially vertical member upper end. A first leg has a first leg upper portion telescopically connected to the first leg lower portion so that the first leg upper portion slides relative to the first leg lower portion. The first leg upper portion has a first leg upper portion upper end and a first leg upper portion lower end. The first leg upper portion upper end is pivotally connected to the substantially vertical member upper end. The first leg has a first leg stowed position which is telescopically retracted.

12 Claims, 7 Drawing Sheets

(56) References Cited

U.S. PATENT DOCUMENTS

2003/0024444 A1* 2/2003 Welch ..... A47F 5/137
108/115
2003/0056699 A1* 3/2003 Malizia ..... A47B 3/00
108/115
2005/0274300 A1* 12/2005 Chen ..... A47B 3/002
108/115
2006/0185566 A1* 8/2006 Mangano ..... A47B 3/002
108/115
2010/0229767 A1* 9/2010 Chiu ..... A47B 31/04
108/115

* cited by examiner

FOLDING TABLE

This application is a continuation in part of both co-pending U.S. non-provisional utility patent application Ser. No. 14/598,600 filed Jan. 16, 2015, which in turn claims priority from U.S. provisional application 61/979,202 filed Apr. 14, 2014 entitled Folding Table and from U.S. provisional application 61/951,206 filed Mar. 11, 2014 entitled Folding Table, by same inventors Jennifer Ying Lai and Jiaxun Cao, the disclosures of which are incorporated herein by reference.

This application is also a continuation in part of co-pending U.S. non-provisional utility patent application Ser. No. 14/598,824 filed Jan. 16, 2015, which in turn claims priority from U.S. provisional application 61/979,202 filed Apr. 14, 2014 entitled Folding Table and from U.S. provisional application 61/951,206 filed Mar. 11, 2014 entitled Folding Table, by same inventors Jennifer Ying Lai and Jiaxun Cao, the disclosures of which are incorporated herein by reference.

FIELD OF THE INVENTION

The present invention is in the field of folding tables.

DISCUSSION OF RELATED ART

A variety of different folding tables have provided compact work and storage areas. A variety of folding tables had been made in the prior art. Folding tables have generally had a pair of foldable legs. Unfortunately, many times, the folding legs require a substantial amount of strength to fold and unfold. Sometimes, more than one person is needed for folding the table.

SUMMARY OF THE INVENTION

A folding table has a plank member having a plank member forward end and a plank member rearward end. A substantially vertical member is pivotally connected to the plank member. The substantially vertical member has a substantially vertical member upper end and a substantially vertical member lower end. The plank member is pivotally connected to the substantially vertical member upper end. A first leg has a first leg upper portion slidingly such as telescopically connected to the first leg lower portion so that the first leg upper portion slides relative to the first leg lower portion. The first leg upper portion has a first leg upper portion upper end and a first leg upper portion lower end. The first leg upper portion upper end is pivotally connected to the substantially vertical member upper end. The first leg has a first leg stowed position which is slidingly such as telescopically retracted. The first leg has a first leg deployed position which is slidingly such as telescopically extended. The first leg has a stowed position that is substantially vertical and generally parallel or at less than a 25 degree to the substantially vertical member. The first leg deployed position is angled away from the substantially vertical member.

A second leg table support has a second leg table support upper end and a second leg table support lower end. The second leg table support upper end is pivotally connected to a forward portion of the plank, and the second leg table support lower end is pivotally connected to the first leg lower portion upper end. The second leg table support is configured to fold from a second leg stowed position where the second leg table support is generally parallel or at less than a 25 degree angle to the first leg, to a second leg deployed position where the second leg table support is angled away from the first leg.

The folding table optionally has a lower platform pivotally attached to the substantially vertical member lower end. A slider mechanism may be mounted at a telescopic interface between the first leg upper portion and the first leg lower portion. A middle platform can be pivotally connected to the substantially vertical member between the plank and a lower platform. The middle platform is supported by a platform connector pivotally connected to the middle platform. The platform connector is pivotally connected to the middle platform and also pivotally connected to the lower platform to form a four bar mechanism.

A lower platform is pivotally connected to the substantially vertical member lower end via a rear platform support rail. The rear platform support rail is pivotally connected to the substantially vertical member lower end and pivotally connected to the lower platform so that a rear portion of the lower platform rises when converting between a folded position and a deployed position. A lower platform is directly pivotally connected to the substantially vertical member lower end, and a platform support rail is pivotally connected to the lower platform and the first leg lower portion lower end so that a front portion of the lower platform rises when converting between a folded position and a deployed position. A third leg is attached to the substantially vertical member lower end. The third leg extends forwardly from the substantially vertical member lower end.

Figure 1:
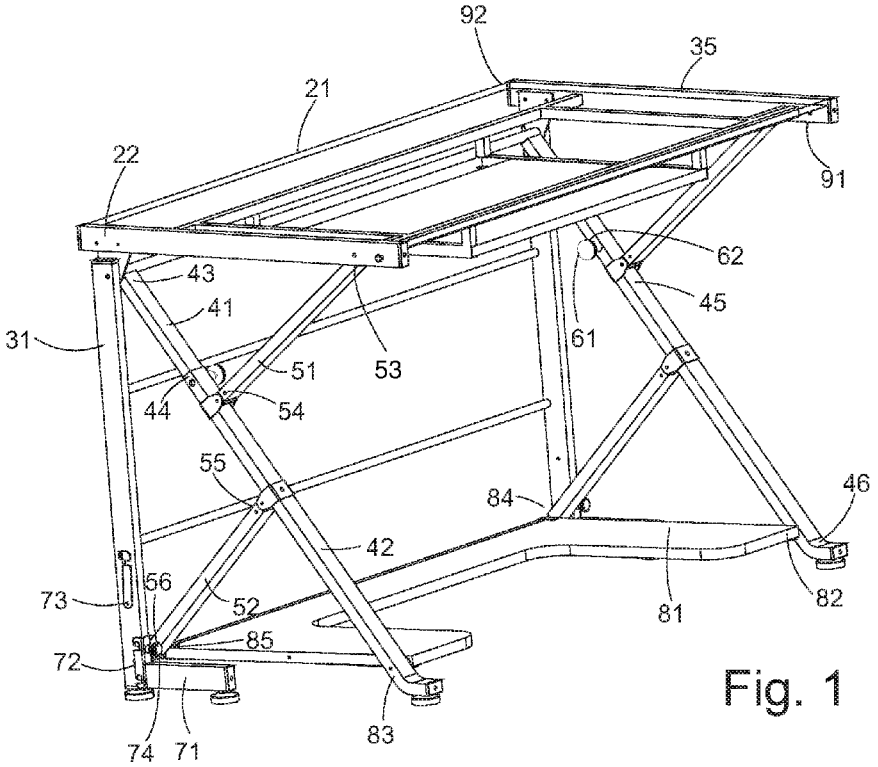
FIG. 1 is a perspective view of the present invention in deployed position.

The following callout list of elements can be a useful guide for referencing the elements of the drawings.

21 Plank
22 Plank Frame
31 Substantially Vertical Member
32 Middle Platform

33 Between Platform Connector
34 Lower Connection Rail
35 Side Connection Rail
36 Caster Wheel
41 First Leg Upper Portion
43 First Leg Upper Portion Upper End
44 First Leg Upper Portion Lower End
42 First Leg Lower Portion
45 First Leg Lower Portion Upper End
46 First Leg Lower Portion Upper End
51 Second Leg Table Support
53 Second Leg Table Support Upper End
54 Second Leg Table Support Lower End
52 Second Leg Lower Portion
55 Second Leg Lower Portion Upper End
56 Second Leg Lower Portion Lower End
61 Locking Pin
62 Telescopic Interface
63 Slider Mechanism
64 Slider Mechanism Sheath
65 Slider Pin
66 Slider Pin Opening
71 Third Leg
72 Third Leg Bracket
73 Third Leg Swivel Lock
74 Third Leg Locking Knob
75 Third Leg Swivel Lock Pin
81 Lower Platform
82 Lower Platform Right Front Hinge
83 Lower Platform Left Front Hinge
84 Lower Platform Right Rear Hinge
85 Lower Platform Left Rear Hinge
86 Platform Support Rail
186 Rear Platform Support Rail
87 Right Platform Support Hinge
88 Left Platform Support Hinge
89 Platform Support Rail Slot
91 Plank Forward Portion
92 Plank Rearward Portion

DETAILED DESCRIPTION OF THE PREFERRED EMBODIMENT

The present invention is a folding table that has a deployed position and a folded position. When folded, the table has members that are all substantially vertical. The table deploys to a deployed position when a user needs to use the table. The table can stand on a supplemental leg after being folded if an optional third leg 71 is attached to the table. The third leg 71 can be attached to a substantially vertical member 31 at a third leg bracket 72 which is secured to the substantially vertical member 31 at a third leg locking knob 74. The substantially vertical member 31 is a part of the table frame. The table frame supports a plank 21. The plank member may have a plank frame 22 and a plank 21. The plank 21 has a plank forward portion 91 facing the user and a rearward portion 92 facing away from the user. The substantially vertical member 31 can be connected directly to the plank 21, or indirectly connected to the plank 21.

The plank 21 is preferably supported by a plank frame 22 and the plank frame 22 can secure to the plank at the left and right side such as at side connection rails 35. For example, a left side connection rail 35 can be attached to a left side of the plank 21 and a right side connection rail 35 can be connected to a right side of the plank 21. The plank frame 22 also includes a pair of crossbeam members that can pass underneath the plank 21 such as a lower connection rail 34 that is attached to an underside of the plank 21. The plank 21 can be formed as a transparent glass or plastic member. The left and right edges of the plank 21 can fit into grooves formed on the side connection rails 35. The side connection rails can be biased toward each other by a pair of crossbeam members. The plank frame 22 is preferably pivotally mounted to the substantially vertical member 31 or to the first leg upper portion. Optionally, the plank frame 22 includes a keyboard drawer that can be mounted to the crossbeam members of the plank frame 22.

Additionally, the folding table has a first leg upper portion 41 with a first leg upper portion upper end 43 and a first leg upper portion lower end 44. The first leg upper portion upper end 43 is preferably pivotally connected to an upper portion of the substantially vertical member 31 or to the plank. The first leg upper portion lower end 44 is preferably telescopically mounted to the first leg lower portion 42 at the first leg lower portion upper end 45. The first leg lower portion lower end 46 can have a support foot. The first leg upper portion 41 is telescopically connected to the first leg lower portion 42. Preferably, the first leg lower portion 42 is sized to receive the first leg upper portion 41 at a telescopic interface 62. A securing device such as a locking pin 61 can secure the first leg upper portion to the first leg lower portion such as by inserting the locking pin 61 through a locking opening in the first leg upper portion that coincides with a locking opening on the first leg lower portion.

The second leg table support has a second leg table support lower end 54 that is swivel mounted to the first leg lower portion 42 at the first leg lower portion upper end 45. The second leg table support upper end 53 is swivel connected to the plank frame 22 or to the plank 21. The plank 21 may comprise a portion of the plank frame 22 and vice versa. The side rail connection 35 can be formed as an aluminum channel that has an inside surface which is swivel jointed to the second leg table support 51 at the second leg table support upper end 53.

Optionally, the second leg table support 51 can have a second leg table support lower portion 52. The second leg table support lower portion 52 can have a second leg lower portion upper end 55 that is swivel connected to the first leg lower portion 42. Additionally, the second leg lower portion 52 can have a second leg lower portion lower end 56 that is swivel mounted to a lower portion of the substantially vertical member 31. The substantially vertical member 31 can be formed as a pair of vertical posts that are connected horizontally by a pair or more of round cross-section crossbeams that connect between the right vertical post and the left vertical post.

The lower platform 81 can be hinged at a forward portion to the first leg lower portion lower end 46. More specifically, the lower platform 81 can be hinged at a lower platform right front hinge 82 to a right first leg lower portion 42 and at a lower platform left front hinge 83.

Figure 7:
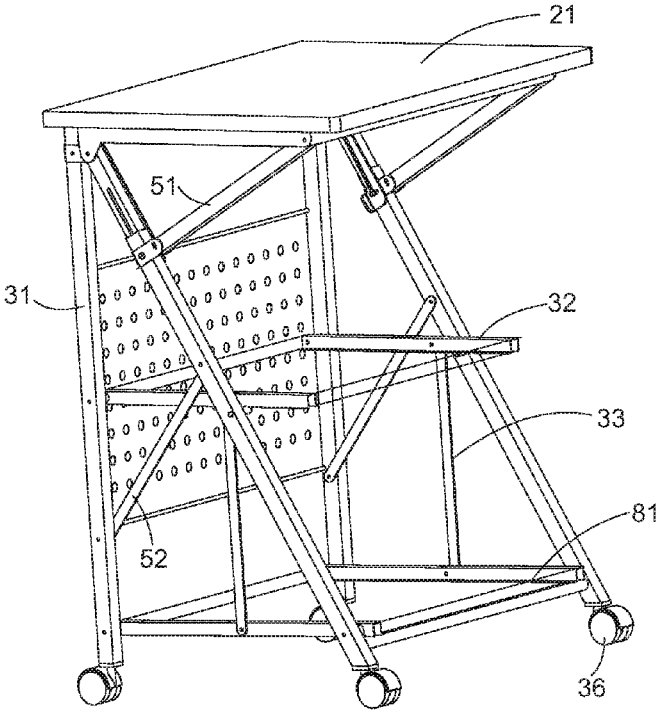
FIG. 7 is a perspective view of the present invention showing a middle platform.
Figure 8:
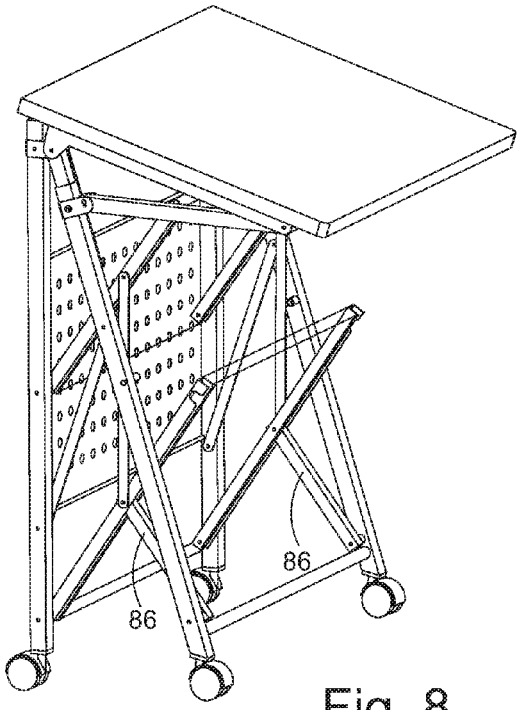
FIG. 8 is a perspective view of the present invention showing a middle platform in folding position.
Figure 9:
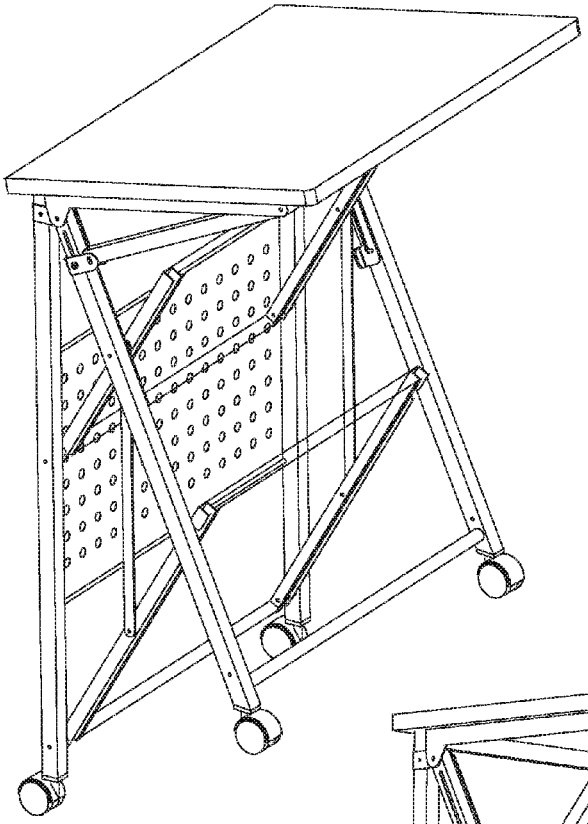
FIG. 9 is an alternate perspective view of the present invention showing a middle platform in folding position.
Figure 10:
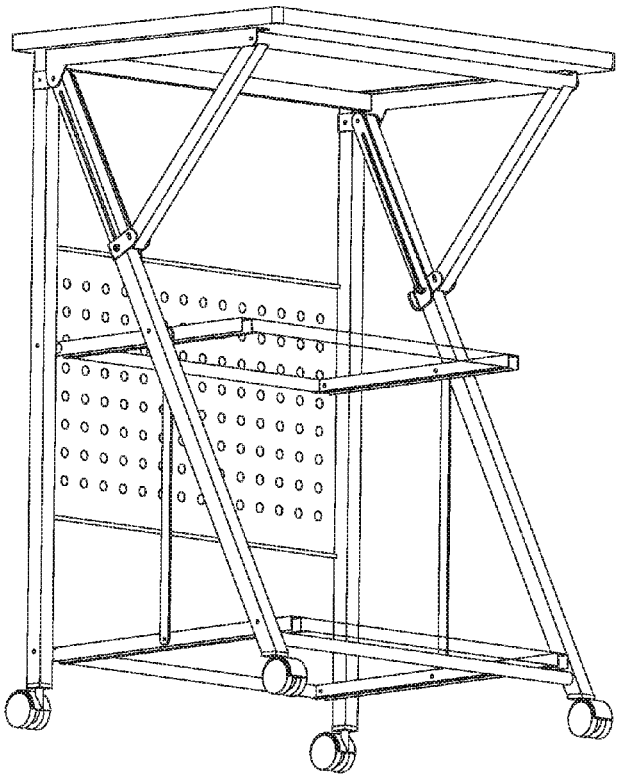
FIG. 10 is an alternate perspective view of the present invention showing a middle platform.
Figure 11:
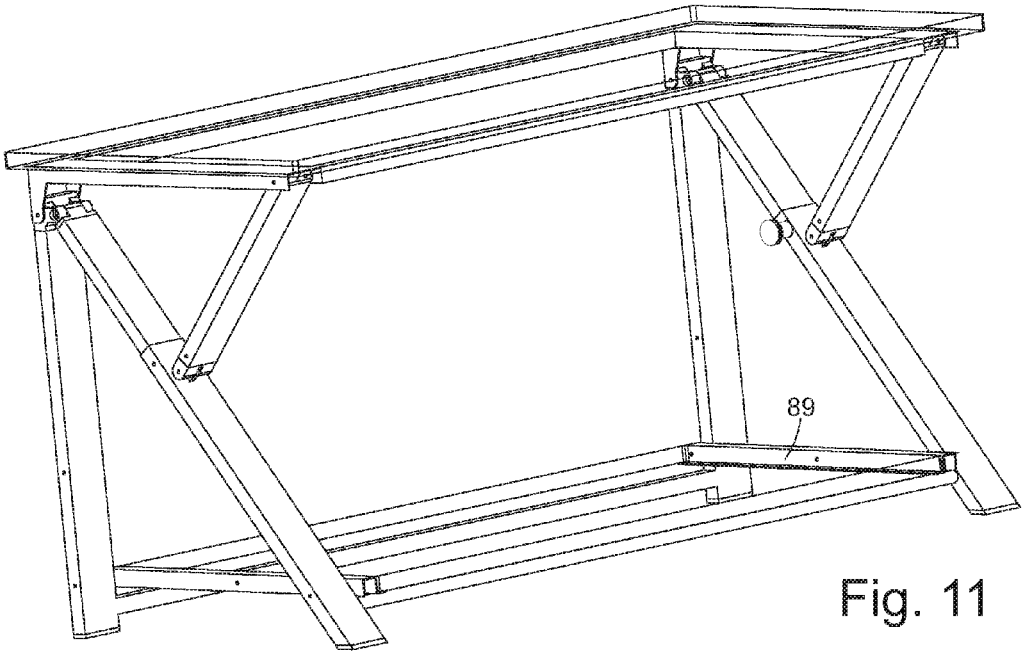
FIG. 11 is a perspective view of the present invention showing an forward upwardly folding lower platform in deployed position.
Figure 12:
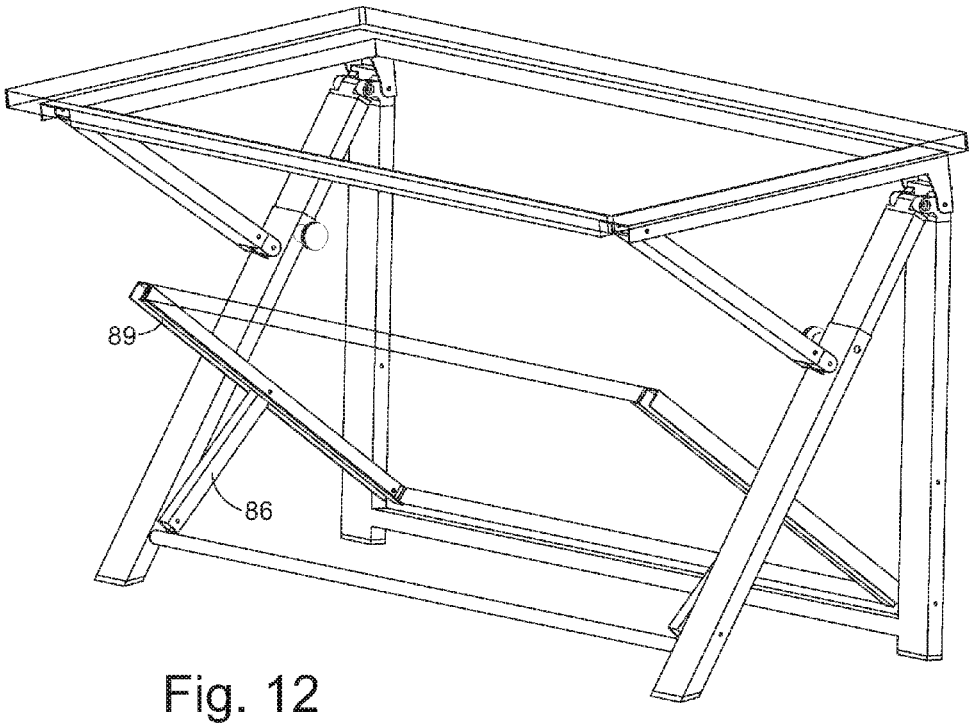
FIG. 12 is a perspective view of the present invention showing a forwardly upwardly folding lower platform in folding position.
Figure 13:
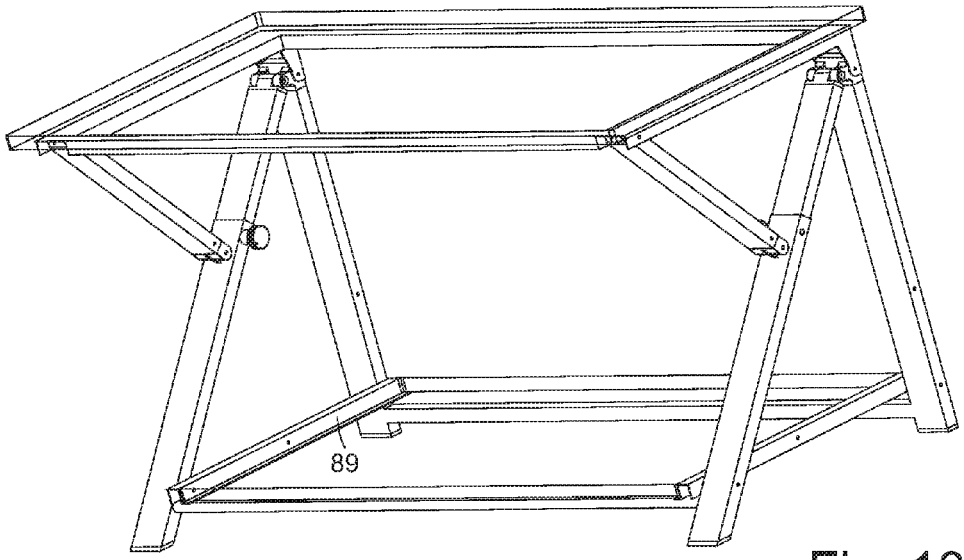
FIG. 13 is a perspective view of the present invention showing a rearwardly upwardly folding lower platform in deployed position.
Figure 14:
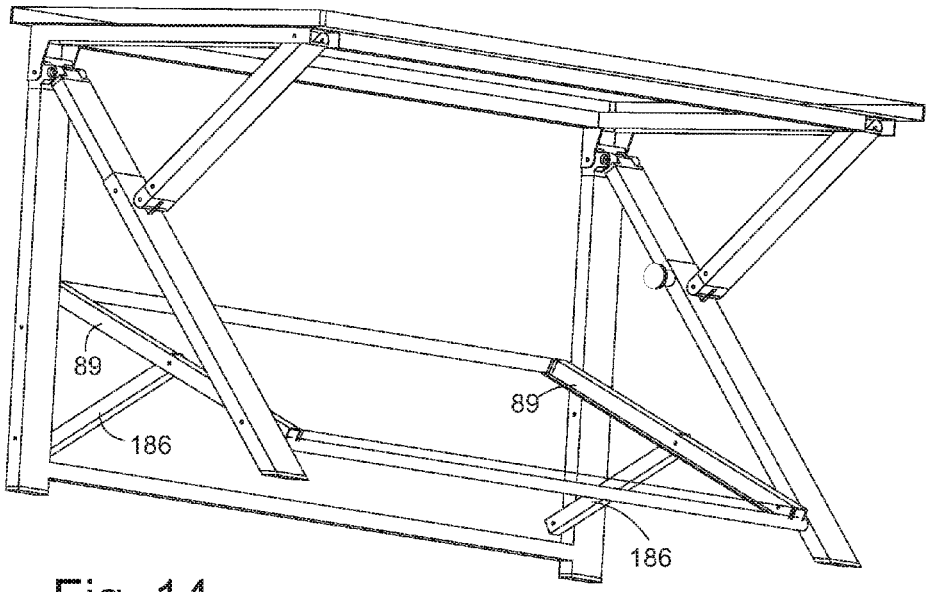
FIG. 14 is a perspective view of the present invention showing a rearwardly upwardly folding lower platform in folding position.

Optionally, as seen in FIG. 7, the middle platform 32 can be hinged to the substantially vertical member 31 and to an upper portion of a between platform connector 33. The between platform connector 33 connects the middle platform 32 to the lower platform 81. The lower platform 81 is supported by the first leg lower portion 42 which in turn is supported by a caster wheel 36 or an adjustable foot.

The platform support rail 86 allows the lower platform 81 to fold upward. The platform support rail 86 can fit inside the platform support rail slot 89, or can be externally mounted. A left platform support rail can be swivel connected to the lower platform 81 at a left platform support hinge 88 and a right platform support rail 86 can be swivel connected to the right platform support hinge 87.

Figure 3:
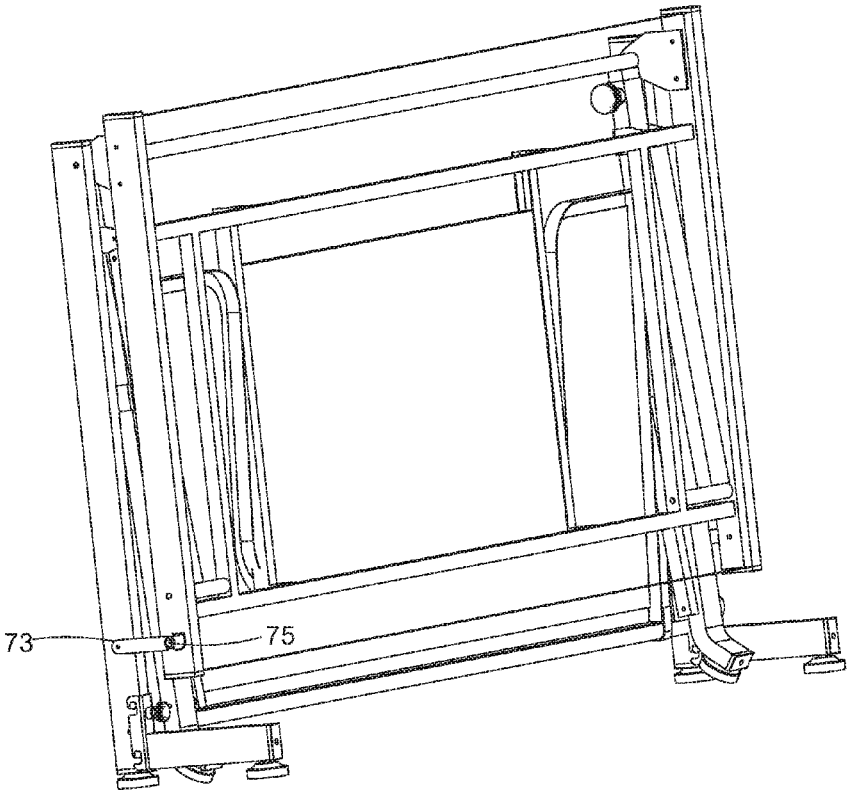
FIG. 3 is a perspective view of the present invention in a folded position.

When in folded position as seen in FIG. 3, the third leg swivel lock 73 can connect to the third leg swivel lock pin 75 to provide a closing bias latch. The third leg swivel lock 73 is mounted slightly above the third leg. After locking, the third leg provides stability to maintain the folded plank 21 in a vertical position. The third leg swivel lock 73 can be engaged when the third leg is installed. Installing the third leg as a precondition allows use of the third leg swivel lock 73 in vertical self standing configuration. The third leg swivel lock 73 is mounted on the substantially vertical support member near the third leg.

Figure 4:
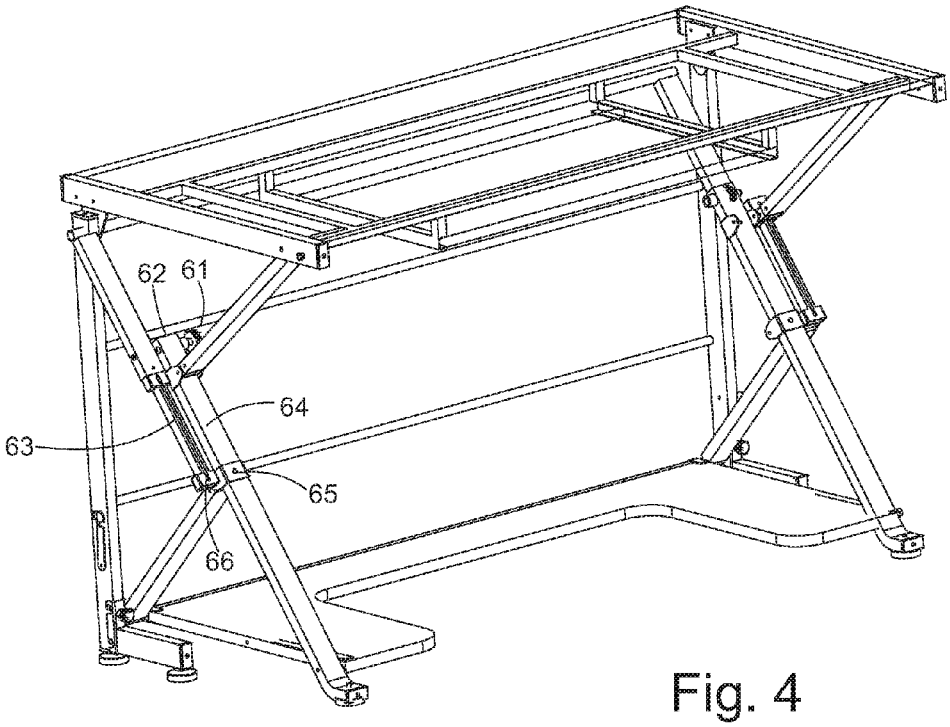
FIG. 4 is a partially exploded perspective view of the present invention showing the slider mechanism.

As seen in FIG. 4, the slider mechanism 63 is exploded away to the left of the slider mechanism sheath 64. The slider mechanism 63 is connected to and preferably extends from the first leg upper portion lower end 44. The slider mechanism 63 during normal operation is enclosed in the slider mechanism sheath 64. The slider mechanism sheath 64 can have a connection for a slider pin 65. The slider pin 65 can be formed as a rivet or screw or bolt. The slider pin opening 66 formed on the slider mechanism 63 can allow engagement of the slider pin 65 to the slider pin opening 66. The slider mechanism may have a slot that receives a slider pin 65. The slider mechanism can be a linear bearing.

Figure 2:
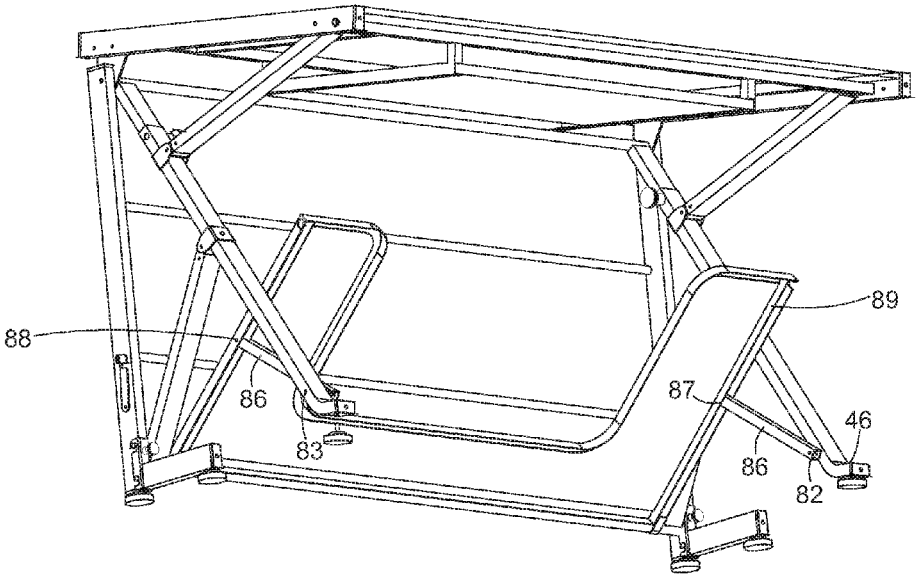
FIG. 2 is a perspective view of the present invention in a folding position.
Figure 5:
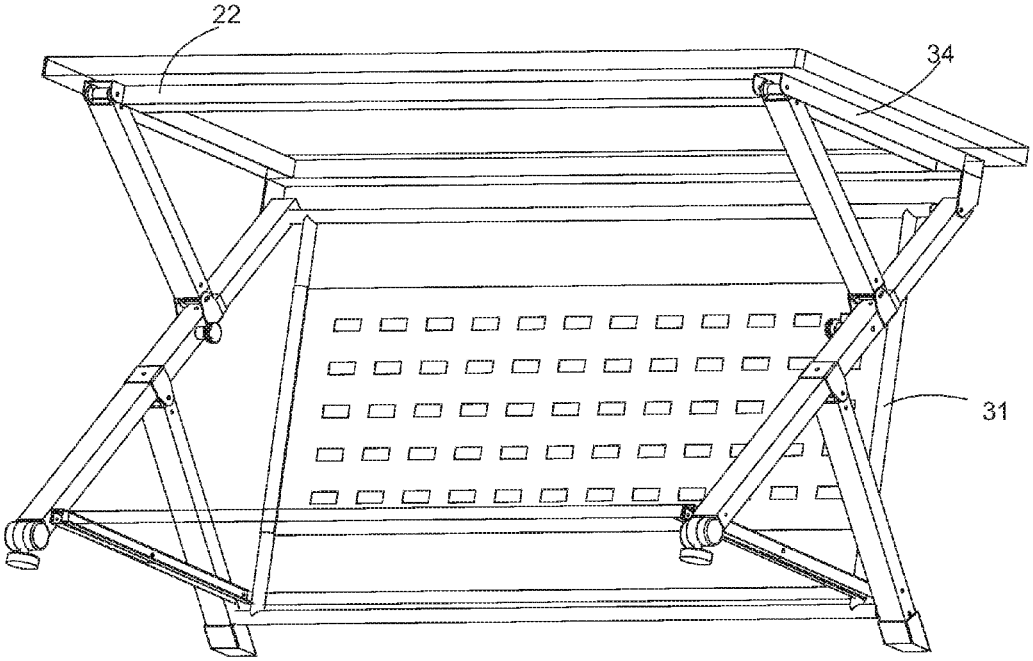
FIG. 5 is a perspective view of the present invention showing a lower connection rail.
Figure 6:
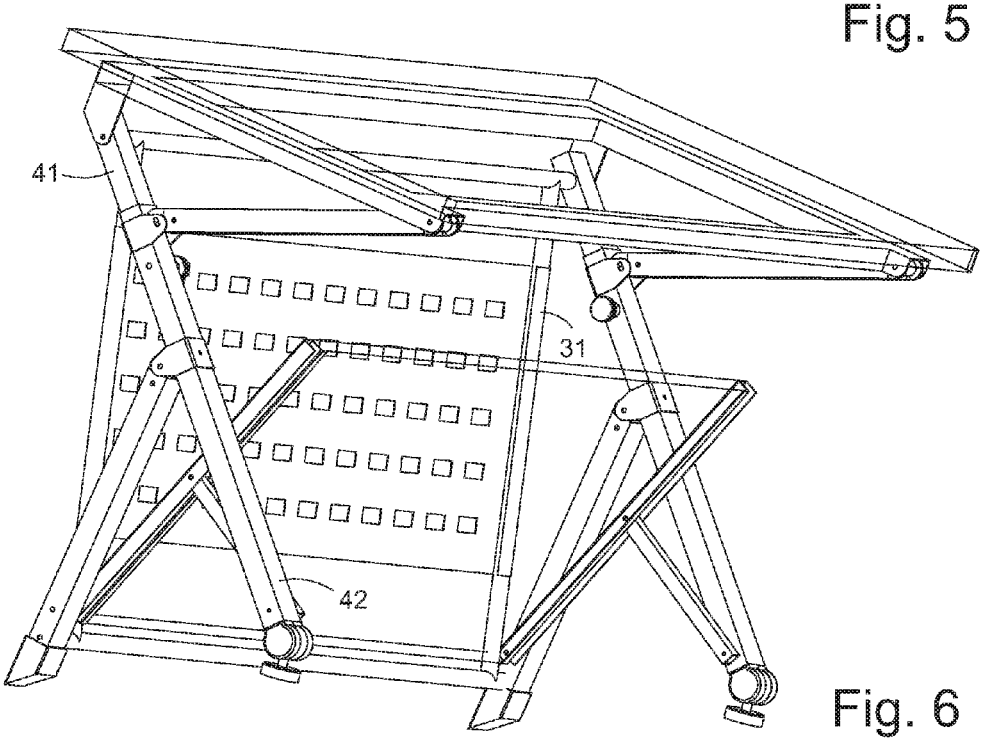
FIG. 6 is a assertive view of the present invention showing a lower connection rail in folding position.

As seen in FIGS. 5 and 6, the substantially vertical member 31 can be pivotally connected to the legs without bearing directly on the floor. The substantially vertical member 31 connects between the second leg lower portion at a substantially vertical member lower end and connects to the first leg upper portion upper end at the substantially vertical member upper end, without directly connecting to the plank. Thus, the footing supporting the substantially vertical member 31 as seen on FIGS. 1, 2 is optional and can be omitted. In either configuration, the plank frame 22 preferably has a pair of hinge brackets that protrude downward for receiving the first leg upper portion 41 and/or the substantially vertical member 31.

The left first leg upper portion 41 and the left first leg lower portion 42 are on a left plane. Similarly, the right first leg upper portion and the right first leg lower portion are also on a right plane. The position and closing motion of the second leg table support 51 as well as the second leg lower portion 52 are both coplanar with the first leg. In a folded position, the first leg upper portion 41 is parallel to the second leg table support 51. In a folded position, the second leg lower portion 52 is parallel to the first leg lower portion 41. In a folded position, the first leg has a retracted position and decreases in length when the first leg upper portion slides into the first leg lower portion. Alternatively, the first leg upper portion can receive the first leg lower portion if the dimensions are reversed.

During normal usage, a user can fold the plank 21 upwards so that it rotates from a vertical position to a horizontal position. The user can then engage the locking pin 61 to lock the telescopic interface 62 between the first leg upper portion 41 and the first leg lower portion 42. The locking pin 61 preferably has a spring bias that keeps the locking pin in a locked position requiring a user to pull for disengagement. Alternatively, the locking pin 61 can have a screw structure so that a round knob of the locking pin 61 can be used for introducing the screw structure into the first leg upper portion 41 and the first leg lower portion 42.

The invention claimed is:

1. A folding table comprising:

a. a plank member having a plank member forward end and a plank member rearward end;

b. a substantially vertical member pivotally connected to the plank member, wherein the substantially vertical member has a substantially vertical member upper end and a substantially vertical member lower end, wherein the plank member is pivotally connected to the substantially vertical member upper end;

c. a first leg having a first leg upper portion slidingly connected to the first leg lower portion so that the first leg upper portion slides relative to the first leg lower portion, wherein the first leg upper portion has a first leg upper portion upper end and a first leg upper portion lower end, wherein the first leg upper portion upper end is pivotally connected to the substantially vertical member upper end, wherein the first leg has a first leg stowed position which is slidingly retracted, and wherein the first leg has a first leg deployed position which is slidingly extended, wherein the first leg stowed position is substantially vertical and generally parallel or at less than a 25 degree parallel to the substantially vertical member, and wherein the first leg deployed position is angled away from the substantially vertical member;

d. a second leg table support having a second leg table support upper end and a second leg table support lower end, wherein the second leg table support upper end is pivotally connected to a forward portion of the plank, and wherein the second leg table support lower end is pivotally connected to the first leg lower portion upper end, wherein the second leg table support is configured to fold from a second leg stowed position where the second leg table support is generally parallel or at less than a 25 degree angle to the first leg, to a second leg deployed position where the second leg table support is angled away from the first leg.

2. The folding table of claim 1, further including a lower platform pivotally attached to the substantially vertical member lower end.

3. The folding table of claim 1, further including a slider mechanism mounted at a telescopic interface between the first leg upper portion and the first leg lower portion.

4. The folding table of claim 1, further including a middle platform pivotally connected to the substantially vertical member between the plank and a lower platform, wherein the middle platform is supported by a platform connector pivotally connected to the middle platform, wherein the platform connector is pivotally connected to the middle platform and also pivotally connected to the lower platform to form a four bar mechanism.

5. The folding table of claim 1, further including a lower platform pivotally connected to the substantially vertical member lower end via a rear platform support rail, wherein the rear platform support rail is pivotally connected to the substantially vertical member lower end and pivotally connected to the lower platform so that a rear portion of the lower platform rises when converting between a folded position and a deployed position.

6. The folding table of claim 1, further including a lower platform directly pivotally connected to the substantially vertical member lower end, and a platform support rail pivotally connected to the lower platform and the first leg lower portion lower end so that a front portion of the lower platform rises when converting between a folded position and a deployed position.

7. The folding table of claim 1, further including a third leg attached to the substantially vertical member lower end, wherein the third leg extends forwardly from the substantially vertical member lower end.

8. The folding table of claim 7, further including a lower platform pivotally attached to the substantially vertical member lower end.

9. The folding table of claim 7, further including a slider mechanism mounted at a telescopic interface between the first leg upper portion and the first leg lower portion.

10. The folding table of claim 7, further including a middle platform pivotally connected to the substantially vertical member between the plank and a lower platform, wherein the middle platform is supported by a platform connector pivotally connected to the middle platform, wherein the platform connector is pivotally connected to the middle platform and also pivotally connected to the lower platform to form a four bar mechanism.

11. The folding table of claim 7, further including a lower platform pivotally connected to the substantially vertical member lower end via a rear platform support rail, wherein the rear platform support rail is pivotally connected to the substantially vertical member lower end and pivotally connected to the lower platform so that a rear portion of the lower platform lowers when converting from a folded position to a deployed position.

12. The folding table of claim 7, further including a lower platform directly pivotally connected to the substantially vertical member lower end, and a platform support rail pivotally connected to the lower platform and the first leg lower portion lower end so that a front portion of the lower platform lowers when converting from a folded position to a deployed position.

* * * * *